United States Patent [19]

Cordier

[11] Patent Number: 4,659,616

[45] Date of Patent: Apr. 21, 1987

[54] FIBER MATERIAL FOR THE MANUFACTURE OF COATINGS FOR ELASTIC CALENDER ROLLS AND IMPROVED CALENDER ROLLS

[76] Inventor: Dieter Cordier, Jägerthal 11, D-6702 Bad Dürkheim, Fed. Rep. of Germany

[21] Appl. No.: 814,540

[22] Filed: Dec. 20, 1985

Related U.S. Application Data

[63] Continuation of Ser. No. 577,181, Feb. 6, 1984, abandoned.

[30] Foreign Application Priority Data

Feb. 4, 1983 [DE] Fed. Rep. of Germany ..... 3303703

[51] Int. Cl.[4] ..... D04H 1/08

[52] U.S. Cl. ..... 428/281; 428/283; 428/367; 428/906; 428/909

[58] Field of Search ..... 428/906, 909, 283, 281, 428/367

[56] References Cited

U.S. PATENT DOCUMENTS 4,256,801 3/1981 Chuluda ..... 428/367

*Primary Examiner*—Marion C. McCamish

[57] ABSTRACT

The present invention relates to a fibrous material for coating supercalender rolls to improve the resistance to scorching, the fibrous material containing conventional fibers in combination with carbon fibers. An improved heat dissipation inside the roll is achieved without loss of physical properties of the roll coatings. A small percentage of lampblack can also be added to the fibrous material. The invention also relates to an improved elastic supercalender roll which is coated with such a fibrous material.

9 Claims, No Drawings

FIBER MATERIAL FOR THE MANUFACTURE OF COATINGS FOR ELASTIC CALENDER ROLLS AND IMPROVED CALENDER ROLLS

This is a continuation of application Ser. No. 577,181, filed Feb. 6, 1984, now abandoned.

BACKGROUND OF THE INVENTION

1. Field of the Invention

The present invention relates to a fibrous material for the manufacture of fillings for elastic calender rolls, for example, for supercalenders for paper glazing and also relates to elastic calender rolls provided with a filling consisting of compressed fibrous material in combination with carbon fibers.

2. Description of the Prior Art

So-called supercalenders are employed for glazing, i.e., for calendering high-grade printing papers as well as other special papers such as pergamyne (vegetable parchment). The supercalenders consist of a set of successive rolls which form pressure gaps with one another and essentially consist of an alternating series of hard steel rolls and of rolls having a thick elastic jacket which is deformed under the pressure of the pressing gap. The paper is successively conducted back and forth through the individual pressing gaps and is calendered as a result of the speed difference present and also as a result of the temperature produced by the fulling action of the elastic rolls.

A special fibrous material which is passed onto roll cores under high pressures of about 500 to 600 bar and is subsequently cylindrically turned to size and burnished has prevailed as the predominating material for the jacket or filling of the elastic rolls of supercalender assemblies. Cellulose fibers, particularly cotton linters, are usually employed as the fibrous material. These cellulose fibers can, however, have other fibrous materials added to them. Thus, for example, the European standard filling for elastic calender rolls consists of 80% cotton and 20% wool fibers. Roll fillings containing up to 50% asbestos fibers can also be utilized for special purposes.

The fibrous material employed for filling elastic calender rolls and consisting essentially of cotton fibers with possibly some wool fibers in the majority of cases is employed in the form of a non-woven web which is manufactured according to traditional paper manufacturing methods on endless wire machines. Octagonal or round disks having a center opening for the roll core cut from the fibrous web thus produced, are then stacked on the roll core and compressed in the axial direction with pressures of up to 600 bar. The rolls processed in this manner can then be turned to size and burnished.

It is not absolutely necessary to make the fibrous material for the roll filling available in the form of a paper-like fibrous web. Manufacturing methods are also known wherein the fiber material such as carded cotton fiber is pressed into the roll core in some other manner. At present, however, calender roll compositions in the form of paper-like webs are nearly exclusively employed for recoating elastic calender rolls.

Cellulose fibers, particularly cotton linters, utilized for the filling of elastic calender rolls offer improved technical properties for calendering the papers to be processed which accounts for their widespread employment. However, they cause a number of potential and generally cost-increasing difficulties for operating the calenders. Considerably high temperatures are produced in performing the fulling function at the circumferential region of the rolls, with the considerable line pressures of up to 300 daN/cm which are frequently employed. Considering the relatively poor thermal conductivity of the cellulose material of the cotton fibers, a heat build-up due to non-dissipated thermal energy arises in the roll jackets, the build-up leading to the highest temperatures in a region at about 10 mm below the roll surface. In particular, temperature peaks occur in the area causing superficial damage to the rolls, such damage easily giving rise to tearing of the glazed paper web or permitting the passage of foreign bodies through the roll gaps. The elevated temperatures occur particularly at such locations that the fibrous material of the roll filling actually burns below the surface. As a result, the roll filling loses its specific properties in these regions and generally becomes unusable for further employment. When this occurs, considerable costs are incurred for recoating.

A number of structural measures have been tried in calenders in order to prevent temperature peaks that lead to roll scorching from occurring. One such measure is the use of internal roll cooling. Considering the poor thermal conductivity of the cellulose material, however, such measures have only a limited effect. The difficulties involved as well as measures that have been tried to eliminate these difficulties are described, for example, by E. Münch and W. Schmitz in the "Wochenblatt fur Papierfabrikation" 1980, Number 11/12. In this publication, the expert authors confirm that the technological possibilities of a supercalender could not hitherto be exploited because of the danger of scorching the elastic rolls which has not yet been controlled. Since calenders for special papers such as pergamyne require a very high glaze, calender roll fillings containing up to 50% asbestos fibers have been employed because these fibers resist the high temperatures to a larger extent. In terms of their other physical properties, however, such roll fillings are not as beneficial. Further attempts have been undertaken to find heat resistant fiber materials for calender roll fillings which equal the cotton coatings with respect to technical properties. Up to now, however, these efforts have been unsuccessful.

SUMMARY OF THE INVENTION

The object of the present invention is to resolve the problem by improving the heat dissipation from the roll filling without impairing the physical properties of the hitherto known fibrous materials for elastic calender fillings. It has surprisingly been found that the temperature build-up occurring beneath the roll surface can be nearly eliminated by means of the addition of controlled amounts of carbon fibers to the fibrous substances of the material for the roll filling and that the physical properties, particularly the elasticity of the fibrous material, could even be simultaneously improved.

When "fibrous material" is mentioned in this context, it means the overall material for the roll filling, this generally being made available in the form of a paper-like web. "Fibrous substance", on the other hand, means the actual fibrous substances in the fiber material which together with other potential additives form the fibrous material as a material for the roll filling.

DESCRIPTION OF THE PREFERRED EMBODIMENTS

In accordance with the present invention, the amount of carbon fiber in the overall fibrous substance is in the range from 1.5 to 15% by weight, and preferably about 3 to 12% by weight. Depending on the other conditions and additives, some effect can be observed with a proportion of 2 weight %. Quantities in excess of 10 weight % are possible but do not lead to a proportionately improved effect in the elimination of temperature build-up beneath the roll surface. Since carbon fiber is relatively expensive, higher added quantities prove to be disadvantageous from the cost standpoint.

The carbon fiber is selected so that it enters into an adequate mixture with the other fibrous substances in the pulp slurry. Carbon fibers that float in an aqueous solution or that are essentially hydrophobic are less suitable for use as the fibrous substance than one which can be manufactured in the form of a paper in a standard paper manufacturing process. A carbon fiber derived from the carbonization of polyacrylonitrile is preferred for this use. The fiber lengths of the carbon fibers should preferably lie on the order of the prevailing fiber lengths of the other fibrous substances in order to be able to produce a slurry that is as homogeneous as possible. The fiber thickness should also be matched in terms of order of magnitude to that of the remaining fibrous substances so that a mutual felting of the fibers can occur in the paper manufacture process. Carbon fibers having a length of 3 mm and a diameter of 5 to 10 microns are capable, for example, of being successfully processed with cotton linters having a length of 2 to 3 mm and a diameter of 17 to 27 microns.

The thermal conductivity properties of the new fiber material can further be improved by the addition of an electrically conductive lampblack to the fibrous substance. Additions of 0.5 to 10 weight % relative to the overall fibrous materials are possible. The effect of the lampblack additive in comparison to the carbon fibers, however, is significantly lower with reference to identical weight proportions. The employment of lampblack in paper manufacture also has the disadvantage that this non-fibrous material is poorly retained on the papermaking wire and therefore loads the water circulation. The carbon fiber contributes to the strength and elasticity of the paper. A potential addition of lampblack in appropriate proportions to the carbon fiber content could thus be determined on a case-by-case basis involving technical and cost points of view.

In combination with the carbon fibers, the preferred paper type webs according to the invention consist essentially only of cotton fibers or of cotton linters and wool in weight ratios of 7:3 to 9:1.

The invention also relates to the use of the new fibrous substance for the manufacture of fillings for elastic smooth rollers, particularly supercalender rollers, as well as glazing machine rollers that are provided with a filling consisting of compressed fiber material which contains a proportion of carbon fibers, preferably in the amounts described above for the paper material. The filling of the improved rolls of the present invention need not necessarily have proceeded from a paper, and it is possible therefore to use a suitable lampblack additive.

The following examples are intended to explain the invention in greater detail without representing a restriction in the scope of the invention.

EXAMPLE 1

Laboratory sheets having a basis weight of approximately 150 g/m$^2$ and consisting of a fibrous substance consisting of 90% cotton linters and 10% carbon fiber were produced on a laboratory sheet maker of the "Rapid-Köthen" type. A carbon fiber derived from polyacrylonitrile having the designation "Sigrafil SCF 3" produced by SIGRI Elektrographit GmbH was employed as the carbon fiber. The fibers had a fiber length of 3 mm and a fiber diameter between 5 and 10 microns. The diameter of the carbon fiber thus amounted to about one-half the diameter of the cotton linters employed, which usually range from about 17 to 27 microns. The fiber length of second-cut cotton linters lies between about 2 and 3 mm. The length of the carbon fibers thus essentially conformed to the length of the cellulose fibers employed.

These papers were tested as to their suitability in a laboratory testing process which essentially simulates the load of elastic calender rolls. This testing procedure is mentioned in the previously cited publication by Münch and Schmitz. In this testing procedure, a cube having an edge length of 40 mm and consisting of sheets of the test paper placed on top of one another is pressed under a pressure which is employed in the manufacture of the calender roll fillings. A ram is then put in place on this test cube, the ram being subjected to alternating stress by means of an air hammer. Temperature sensors are inserted into the test cube below the load location, with a first temperature sensor being 10 mm beneath the surface and a second temperature sensor 20 mm beneath the surface. The alternating stress of the test cube is carried out until the region below the ram burns, i.e., a so-called burn-out occurs. For traditional calender roll papers consisting of about 80% cotton fiber and 20% wool fiber, the test conditions for the ram include a load of 50 kp and a frequency of 50 Hz, corresponding to an alternating pressure of 5.0 bar.

A 20-minute service life of a test cube using traditional material is considered good and a 10-minute service life is considered poor. With traditional calender roll papers, the temperature difference between the two test sensors is about 90° C. toward the end of the test. Since the temperature gradient between the two test sensors is a measure of the thermal conductivity of the specimen, the poor heat dissipation of calender roll papers based on cellulose is apparent from this value, and leads to the aforementioned temperature build-up and finally to burn-out beneath the specimen surface.

With the test paper produced according to the present invention, burn-out had not yet occurred even after a test duration of 40 minutes. The temperature difference between the first and second sensors rose to 30° C. after a short time and did not change thereafter, from which it may be concluded that a state of equilibrium had occurred in the heat dissipation so that a burn-out of the specimen below the ram would no longer be anticipated.

EXAMPLE 2

A test cube was again produced under the same conditions as described in Example 1. The load by the ram, however, was doubled. With traditional calender roll papers, a burn-out occurs within a few minutes under this type of stress. With the test paper of the invention, however, burn-out did not occur even under these intensified conditions. A burn-out could be achieved after a service life of 55 minutes only by increasing the load frequency. The temperatures measured at the sensors amounted to 216° C. and 152° C., respectively.

EXAMPLE 3

On the basis of these favorable test results, a calender roll paper consisting of 90% by weight cotton linters and 10% by weight carbon fibers of the type described in Example 1 was manufactured on a commercial paper machine with a machine speed of about 80 to 90 m/min to produce a paper having a basis weight of about 160 to 170 g/m$^2$. This paper was used to cover a calender roll that was employed in a calender for glazing pergamyne papers and which function under extremely high glazing loads. Normally, elastic calender rolls used for this purpose are provided with fillings having a high proportion of asbestos fibers. Earlier tests using elastic roll fillings consisting of cotton yielded service lives for the rolls of less than 2 hours. The roll covered with the filling of the present invention could be operated over a production time of 526 hours. A matte surface was produced and when the filling was subsequently split off, it was found that the roll was completely burned out. In contrast to this phenomenon, most traditional rolls must be replaced because of surface burn-outs. Utilization up to the point of complete burn-out of the material is thereby never achieved. This indicates that the superficial damage that can never be avoided in the operation of a calender and which leads to localized heating and to a localized burn-out does not have any influence with the inventive roll because the local temperature increases are apparently dissipated more completely and are distributed to the overall roll.

The foregoing examples show that fillings for elastic calender rolls can be produced with the improved fiber material, which fillings are superior in terms of stability under load to previously known fillings by a considerable amount. The addition of the carbon fibers also has a technical benefit by use of the rolls. These favorable results enable modifications and new use possibilities in calender technology which had been considered for some time by machine manufacturers but which could not be realized because of the burn-out hazard of traditional calender roll fillings.

It should be evident that various modifications can be made to the described embodiments without departing from the scope of the present invention.

I claim as my invention:

1. An elastic supercalender roll for glazing paper comprising a core and a surface surrounding said core composed of highly axially compressed fiber web material in the form of consolidated individual pieces of cellulosic fibers each containing a sufficient amount of carbon fibers to improve the scorching resistance of the surface.

2. A roll according to claim 1 in which the carbon fibers constitute between 2 and 15% by weight of the overall fiber web material.

3. A roll according to claim 2 in which said surface also contains an electrically conductive lampblack in an amount of from 0.5 to 10% by weight of the overall fiber material.

4. A roll according to claim 1 wherein the proportion of carbon fibers amounts to 3 to 12% by weight of said fiber web material.

5. A roll according to claim 1 wherein the fibers of said web material other than the carbon fibers consist essentially of cotton fibers.

6. A roll according to claim 1 wherein the fibers other than the carbon fibers consist essentially of of cotton linters and wool in a weight ratio of 7:3 to 9:1.

7. A roll according to claim 1 which also includes asbestos fibers in an amount of up to 50% by weight.

8. An elastic supercalender roll comprising a core and a filling surrounding said core, said coating being resistant to burn-out and comprising a paper type web composed of a felted mixture of cellulosic fibers and carbon fibers, the lengths and thicknesses of said carbon fibers approximating those of said cellulosic fibers, said carbon fibers being present in an amount of 1.5 to 15% by weight of said felted mixture.

9. A roll according to claim 8 wherein said carbon fibers have a length of about 3 mm and a diameter of about 5 to 10 microns.

* * * * *